US011323824B2

(12) United States Patent
Jarng

(10) Patent No.: US 11,323,824 B2
(45) Date of Patent: May 3, 2022

(54) EARRING HEARING AID USING RIT

(71) Applicant: Dong Soo Jarng, Seoul (KR)

(72) Inventor: Dong Soo Jarng, Seoul (KR)

( * ) Notice: Subject to any disclaimer, the term of this patent is extended or adjusted under 35 U.S.C. 154(b) by 428 days.

(21) Appl. No.: 16/480,410

(22) PCT Filed: Aug. 31, 2018

(86) PCT No.: PCT/KR2018/010133

§ 371 (c)(1),
(2) Date: Jul. 24, 2019

(87) PCT Pub. No.: WO2020/009267

PCT Pub. Date: Jan. 9, 2020

(65) Prior Publication Data

US 2021/0337318 A1 Oct. 28, 2021

(30) Foreign Application Priority Data

Jul. 4, 2018 (KR) ..... 10-2018-0077395

(51) Int. Cl.
*H04R 25/02* (2006.01)
*H04R 25/00* (2006.01)

(52) U.S. Cl.
CPC ..... *H04R 25/02* (2013.01); *H04R 25/45* (2013.01); *H04R 25/505* (2013.01); *H04R 25/602* (2013.01); *H04R 25/654* (2013.01); *H04R 2430/01* (2013.01)

(58) Field of Classification Search
CPC combination set(s) only.
See application file for complete search history.

(56) References Cited

U.S. PATENT DOCUMENTS

2010/0195853 A1* 8/2010 Joschika ..... H01R 13/2414 439/86
2012/0308061 A1* 12/2012 Zhu ..... H04R 25/505 381/317

(Continued)

FOREIGN PATENT DOCUMENTS

JP 10-056698 2/1998
KR 10-2011-0051237 5/2011
KR 10-1610884 7/2014

(Continued)

OTHER PUBLICATIONS

International Search Report dated Apr. 5, 2019 for PCT/KR2018/010133.

*Primary Examiner* — Angelica M McKinney

(57) ABSTRACT

The present disclosure relates to an earring hearing aid using a receiver in the tube (RIT) including a case which receives therein a microphone, an interface socket, an acoustic processing means, a memory button, a volume controller, a battery and a battery electrode, a receiver which outputs an acoustic signal through a lead wire having one end connected to the acoustic processing means, a hearing aid shell which receives an end of the receiver tube disposed at an opposite side to a side where the receiver is inserted in the receiver tube along a lengthwise direction, a face plate covering an inlet of the hearing aid shell, and an earring hook having one side inserted into an outer peripheral surface of an exit hole of the case to cover an outer peripheral surface of the lead wire exiting through the exit hole.

8 Claims, 5 Drawing Sheets

(56) References Cited

U.S. PATENT DOCUMENTS

| | | | | |
|---|---|---|---|---|
| 2014/0185848 | A1 | 7/2014 | Ozden et al. | |
| 2015/0228268 | A1* | 8/2015 | Chew | H04R 25/607 181/129 |

FOREIGN PATENT DOCUMENTS

| | | | |
|---|---|---|---|
| KR | 10-1759919 | | 7/2017 |
| KR | 101759919 | B1 * | 7/2017 |

* cited by examiner

< Prior Art >

< Prior Art >

EARRING HEARING AID USING RIT

This application claims the priority of Korean Patent Application No. 10-2018-0077395, filed on Jul. 4, 2018 in the KIPO (Korean Intellectual Property Office), the disclosure of which is incorporated herein entirely by reference. Further, this application is the National Stage application of International Application No. PCT/KR2018/010133, filed Aug. 31, 2018, which designates the United States and was published in Korean. Each of these applications is hereby incorporated by reference in their entirety into the present application.

TECHNICAL FIELD

The present disclosure relates to an earring hearing aid, and more particularly, to an earring hearing aid using a receiver in the tube (RIT) that fits each user and cancels an acoustic feedback phenomenon.

BACKGROUND ART

In general, human ear is largely divided into outer ear, middle ear and inner ear.

Vibration of outside sound is collected by the pinna and transmitted to the eardrum along the external auditory meatus.

The external auditory meatus is a sort of resonating tube that is closed by the eardrum on one side, and vibration of the eardrum is transmitted to the inner ear through three ossicles (malleus, incus, and stapes) in the middle ear.

When the vibration of the ossicles is transmitted to the cochlea in the middle ear through the footplate of the stapes, the lymph fluid in the cochlea moves, a few thousand hair cells in the middle part of the cochlea sense the vibration of the lymph fluid and convert the stimulus to an electrical signal.

Additionally, the electrical signal is transmitted to the brain through the central nervous system, thus human can hear 'sound'.

A hearing aid is a device for helping a person with hearing loss to hear sound by converting external acoustic waves to an electrical signal through a microphone, amplifying the electrical signal through an amplifier, converting the electrical signal back into acoustic waves through a receiver and outputting to the external auditory meatus of the person with hearing loss.

Hearing loss using hearing aids is categorized into conductive hearing loss, sensorineural hearing loss, and combined hearing loss.

These three types of hearing loss can be all alleviated by hearing aids, but in general, people with sensorineural hearing loss wear hearing aids, and people with conductive hearing loss usually have medication or surgery for treatment.

Additionally, it is desirable that people with combined hearing loss wear hearing aids after treatment with medication or surgery.

The types of hearing aids are classified into a box type, an earring type and an in-the-ear type according to the shape.

The basic structures of hearing aids are nearly similar irrespective of signal processing methods and types, and an acoustic signal entering a hearing aid is converted to an electrical signal by a microphone called a transmitter.

In the next step, an amplifier is necessary to increase the electrical signal converted by the microphone to a sufficiently large magnitude for a person with hearing loss to hear, and to implement hearing aids that people with hearing loss can conveniently wear in various hearing environments, digital hearing aids using a digital signal processing (DSP) device are developed.

In the last step of sound amplification, a receiver converts the amplified electrical signal back into an acoustic signal that the listener can hear.

In this instance, the amplified acoustic signal has changes in gain and sound pressure specific for each frequency of the hearing aid due to the resonance effect of the receiver, a tube connected to the hearing aid, an acoustic filter or a damper that interrupts the sound flow and the length of the external auditory meatus.

To avoid excessive amplification to protect against further hearing loss and guarantee a clear voice recognition function, it is necessary to perform hearing aid fitting that is best suited for a user.

Here, hearing aid fitting refers to a procedure involving selecting a suitable hearing aid according to the hearing ability of a person with hearing loss, accurately adjusting the amount of amplification and the maximum output range for each frequency range of the hearing aid, periodically checking the hearing aid and taking actions for trouble-free use of the hearing aid.

The function of the microphone is to convert acoustic energy entering the hearing aid to electrical energy, and an ideal microphone produces an output electrical signal of the same waveform as an input voice signal.

The microphone generally has one acoustic inlet (sound hole), and this is referred to as an omni directional microphone.

Some recent hearing aids use a directional microphone having two or more acoustic inlets to improve the signal-to-noise ratio (SNR) that is higher by 3-5 dB than omni directional microphones.

The basic role of the amplifier is to convert a small signal converted to an electrical signal by the microphone into a large energy signal.

The amplifier increases the voltage or current of the electrical signal, and in some cases, amplifies the voltage and the current at the same time.

As a result of amplification, the amplitude of the output signal is higher than the amplitude of the input signal by an integrated circuit (IC or hybrid IC) including one transistor or a few hundreds of thousands or a few million transistors, resistor and condenser in combination.

The receiver has a very similar structure to the microphone, and in the signal flow, the receiver is the reverse of the microphone.

An earring hearing aid directs sound reproduced by the receiver into the auditory canal through a tube connected to an ear mold or tip, causing the eardrum to vibrate.

FIG. 1 is a diagram showing an earring hearing aid in which a conventional receiver is embedded in a body.

As shown in FIG. 1, the earring hearing aid according to the related art includes a microphone 5 and a receiver 7 embedded in a body 1 to transmit sound reproduced by the receiver 7 to a closed ear tip 2 through a hook type tube 4 and a sound tube 3 so that a patient can hear the sound, and in this case, because the transmission pathway is complex and long, sound dropouts and distortions becomes severer in the course of transmission, and the microphone 5 and the receiver 7 are disposed near the body 1, leading to severe interference, so the patient has difficulty in accurately hearing the original sound.

Moreover, the earring hearing aid according to the related art has a problem with acoustic feedback in itself because both the microphone 5 and the receiver 7 are embedded in the body 1, and as sound coming from the receiver 7 is transmitted to the ear tip 2 inserted into the ear through the sound tube 3, acoustic feedback occurs frequently when amplifying sound to make it just a little bit louder.

FIG. 2 is a diagram showing a receiver in the canal (RIC) type earring hearing aid in which a conventional receiver is embedded a hearing aid shell inserted into the ear.

To prevent acoustic feedback occurring in the earring hearing aid as shown in FIG. 1, the RIC type earring hearing aid as shown in FIG. 2 has been suggested and is being widely used.

The RIC type earring hearing aid is configured such that a receiver 12 used to output an acoustic signal from an acoustic processing means through a lead wire 11 is inserted into a receiver tube 13, and the receiver tube 13 is received in a hearing aid shell 20 inserted into the ear.

The RIC type earring hearing aid is inconvenient for users having different ear sizes when wearing it because the length of the lead wire 11 is uniformly set in the manufacture, and because the receiver 12 is inserted into the external auditory meatus, failures occur frequently due to corrosion caused by earwax and sweat.

In FIG. 2, the reference number 14 not described herein is an earwax entry prevention element for preventing earwax from entering the receiver tube 13, the reference number 15 is a face plate covering an inlet of the hearing aid shell 20, and the reference number 15*a* is a through-hole formed in the face plate 15, into which the receiver tube 13 is inserted.

DISCLOSURE OF THE INVENTION

Technical Problem

The present disclosure is designed to solve the conventional problems as described above, and therefore the present disclosure is directed to providing an earring hearing aid using a receiver in the tube (RIT) that fits each user, and cancels an acoustic feedback phenomenon and solves a frequent receiver failure problem.

Technical Solution

To achieve the above-described objects, the present disclosure provides an earring hearing aid using a receiver in the tube (RIT) including a case 100 which receives therein a microphone 130, an interface socket 140, an acoustic processing means 200, a memory button 150, a volume controller 160, a battery 170 and a battery electrode 180, a receiver 300 which outputs an acoustic signal through a lead wire 210 having one end connected to the acoustic processing means 200, and is connected to the other end of the lead wire 210 and inserted into a receiver tube 302 having a predetermined length, a third capacitor C3 which filters out high-level noise included in direct voltage supplied from the battery 170 to the receiver 300 to prevent the high-level noise from being applied to the receiver 300, a hearing aid shell 400 which receives an end of the receiver tube 302 disposed at an opposite side to a side where the receiver 300 is inserted in the receiver tube 302 along a lengthwise direction, and is inserted into an ear to allow the hearing of sound outputted from the receiver 300, a face plate 500 covering an inlet of the hearing aid shell 400, and an earring hook 600 having one side inserted into an outer peripheral surface of an exit hole 117 of the case 100 to cover an outer peripheral surface of the lead wire 210 exiting through the exit hole 117, and the other side rounded to be held and fixed to the ear, wherein a plurality of markers T1,T2,T3 is formed at a predetermined interval along the lengthwise direction on an outer periphery of the receiver tube 302 adjacent to the case 100.

In this instance, when the receiver 300 connected to the other end of the lead wire 210 is inserted into the receiver tube 302 and fixed at a predetermined location, the receiver tube 302 may be cut along two or more of the plurality of markers T1,T2,T3 formed in the receiver tube 302 such that a length from the case 100 to the hearing aid shell 400 inserted into the ear fits for a user's ear size, and the receiver tube 302 having the inserted receiver 300 may be connected to the receiver tube 302 connected to the hearing aid shell 400.

In another configuration, the receiver 300 may be inserted into the receiver tube 302, and the receiver 300 may be fixed to a location where one of the plurality of markers T1,T2,T3 is formed in the receiver tube 302 such that a length from the case 100 to the hearing aid shell 400 inserted into the ear fits for a user's ear size.

Meanwhile, the case 100 includes a case body 110, and a cover 120 having a screw hole 120*a* to cover an opening of the case body 110 by fastening with a fastening bolt 90, and the case body 110 includes a first receiving space 111 which receives the microphone 130, a second receiving space 112 which receives the acoustic processing means 200, a third receiving space 113 which receives the memory button 150, a fourth receiving space 114 which receives the volume controller 160, a fifth receiving space 115 which receives the battery 170, a sixth receiving space 116 which receives the battery electrode 180 in contact with each of a positive electrode and a negative electrode of the battery 170, an exit hole 117 through which the lead wire 210 exits, the lead wire 210 for outputting the acoustic signal from the acoustic processing means 200 to the receiver 300, and a screw hole 118 for the fastening bolt 90 to couple the case body 110 and the cover 120.

Furthermore, the acoustic processing means 200 includes a voltage regulator 202 to, when a switch 172 is operated to switch on, receive the direct voltage supplied from the battery 170, regulate to a predetermined direct voltage and output it, a first capacitor C1 to filter out high-level noise included in the direct voltage regulated to the predetermined direct voltage by the voltage regulator 202 and supply to the microphone 130, a second capacitor C2 to receive an acoustic signal received by the microphone 130 and filter out high-level noise included in the acoustic signal, an A/D converter 204 to receive the analog acoustic signal having undergone high-level noise filtering by the second capacitor C2 and convert into a digital acoustic signal, an amplification means 206 to receive the digital acoustic signal outputted from the A/D converter 204 and amplify to a predetermined level, an EEPROM 208 to receive a news hearing parameter M1, a music hearing parameter M2, a conversation hearing parameter M3 and a conversation hearing in noise parameter M4 from a personal computer through the interface socket 140 and store an interfaced mode signal, an equalizer E to receive a corresponding parameter among the news hearing parameter M1, the music hearing parameter M2, the conversation hearing parameter M3 and the conversation hearing in noise parameter M4 when the memory button 150 is pressed once to four times, receive the digital acoustic signal amplified to the predetermined level by the amplification means 206 and amplify and mix them, a D/A converter 212 to convert the digital acoustic signal amplified and mixed by the equalizer E into an analog acoustic signal, a volume controller 160 to receive the analog acoustic signal outputted from the D/A converter 212, control volume and output it, and a third capacitor C3 to filter out high-level noise included in the direct voltage supplied from the battery 170 to the receiver 300 to prevent the high-level noise from being applied to the receiver 300.

Advantageous Effects

By the above-described technical solution, the present disclosure has the following effects.

The present disclosure installs the receiver connected to the other end of the lead wire within the receiver tube and inserts only the end of the receiver tube disposed at the opposite side to the installation side of the receiver into the hearing aid shell, thereby cancelling an acoustic feedback phenomenon.

Additionally, the present disclosure forms a plurality of markers at a predetermined interval along the lengthwise direction on the outer periphery of the receiver tube, and adjusts the length of the lead wire or the receiver tube as needed, and thus the present disclosure fits each user.

Further, the present disclosure inserts the receiver into the receiver tube adjacent to the case, and receives only the end of the receiver tube disposed at the opposite side to the installation side of the receiver in the hearing aid shell, thereby preventing the conventional problem with frequent failures due to corrosion caused by earwax and sweat because of the receiver configured to be inserted into the external auditory meatus.

MODE FOR CARRYING OUT THE INVENTION

Figure 1:
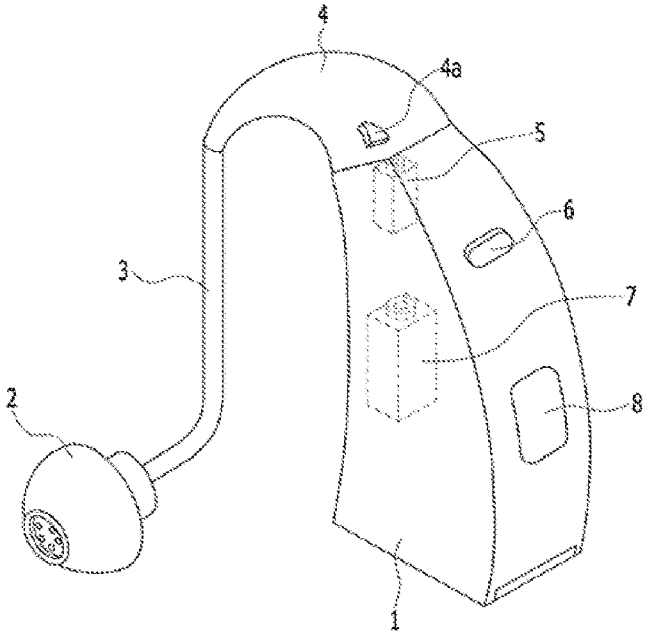
FIG. 1 is a diagram showing an earring hearing aid in which a conventional receiver is embedded in a body.
Figure 2:
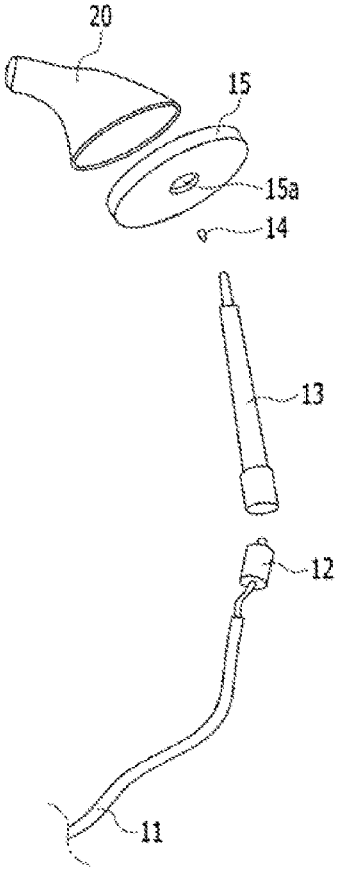
FIG. 2 is a diagram showing a receiver in the canal (RIC) type earring hearing aid in which a conventional receiver is embedded in a hearing aid shell inserted into the ear.
Figure 3:
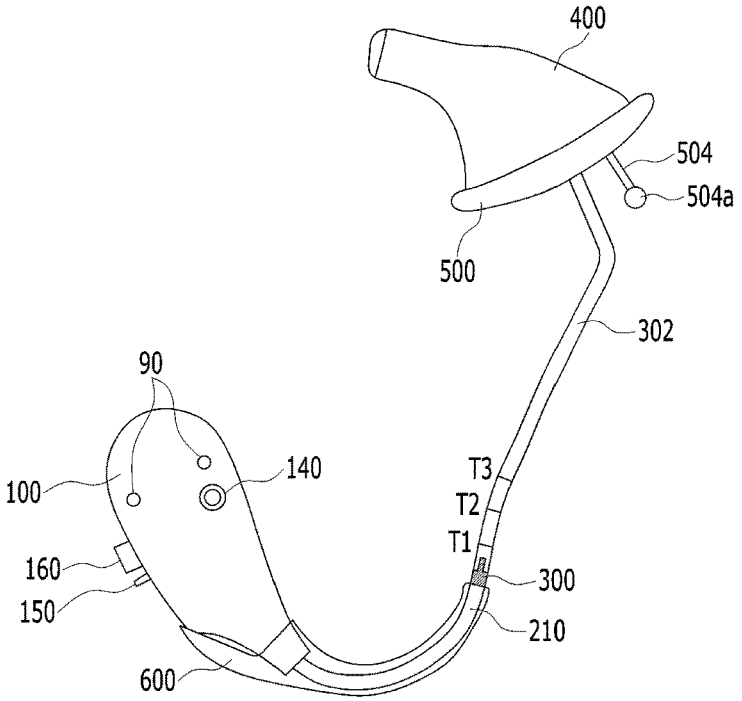
FIG. 3 is a schematic diagram showing an earring hearing aid using a receiver in the tube (RIT) according to the present disclosure.
Figure 4:
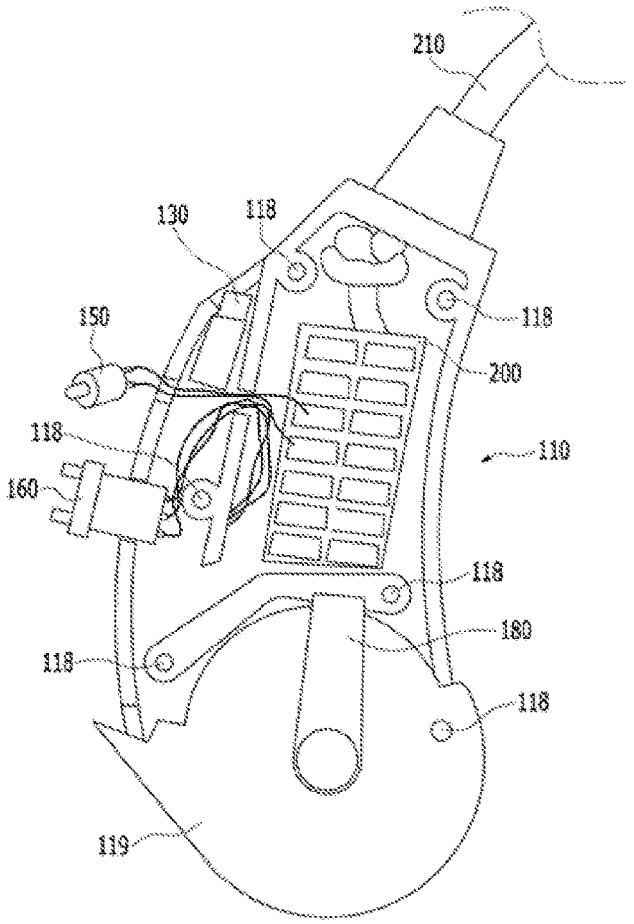
FIG. 4 is a schematic diagram showing a battery, a volume controller, a memory button and a microphone installed in a case body of an earring hearing aid using RIT according to the present disclosure.
Figure 5:
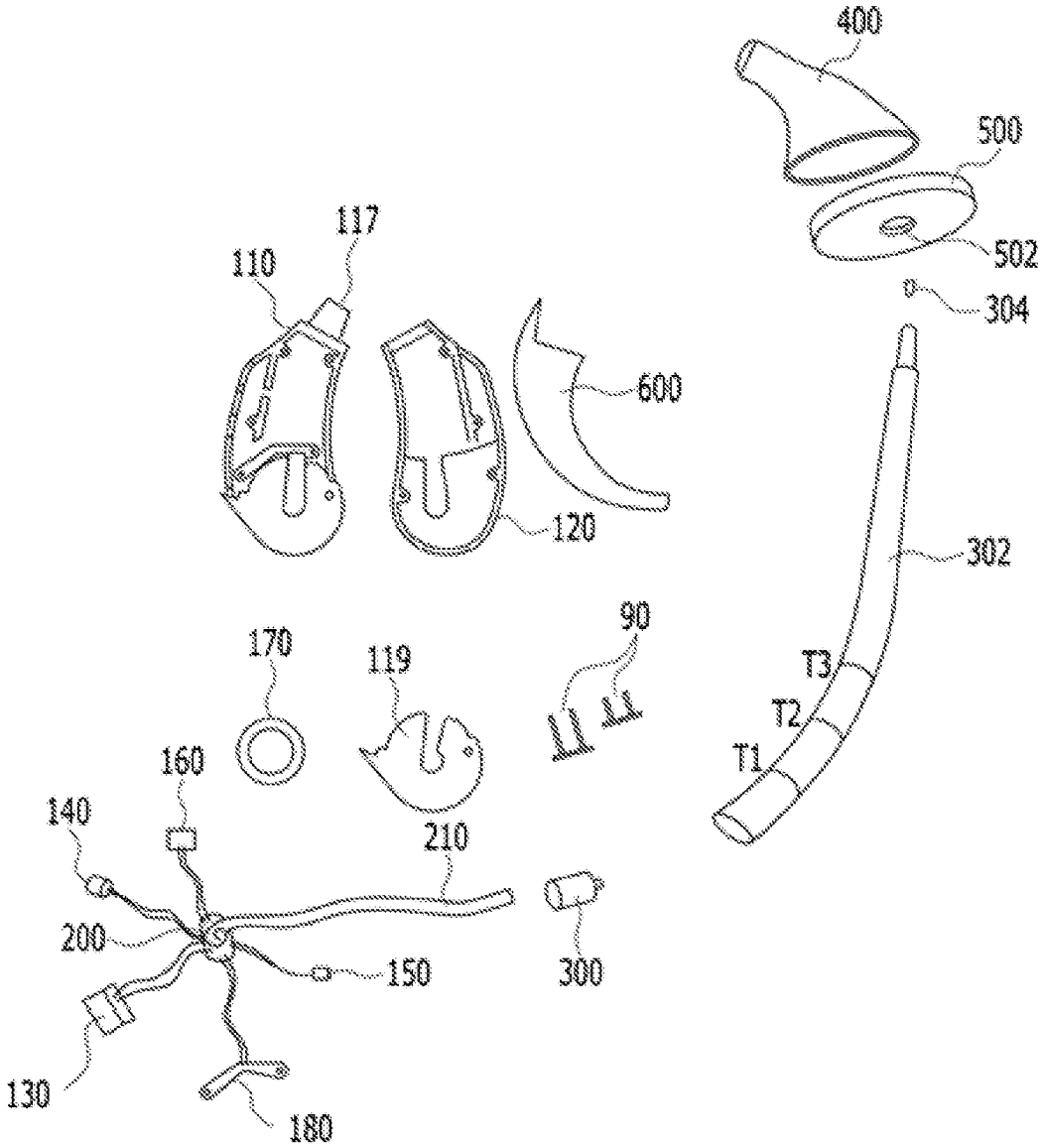
FIG. 5 is an exploded diagram of the components of an earring hearing aid using RIT according to the present disclosure.
Figure 6:
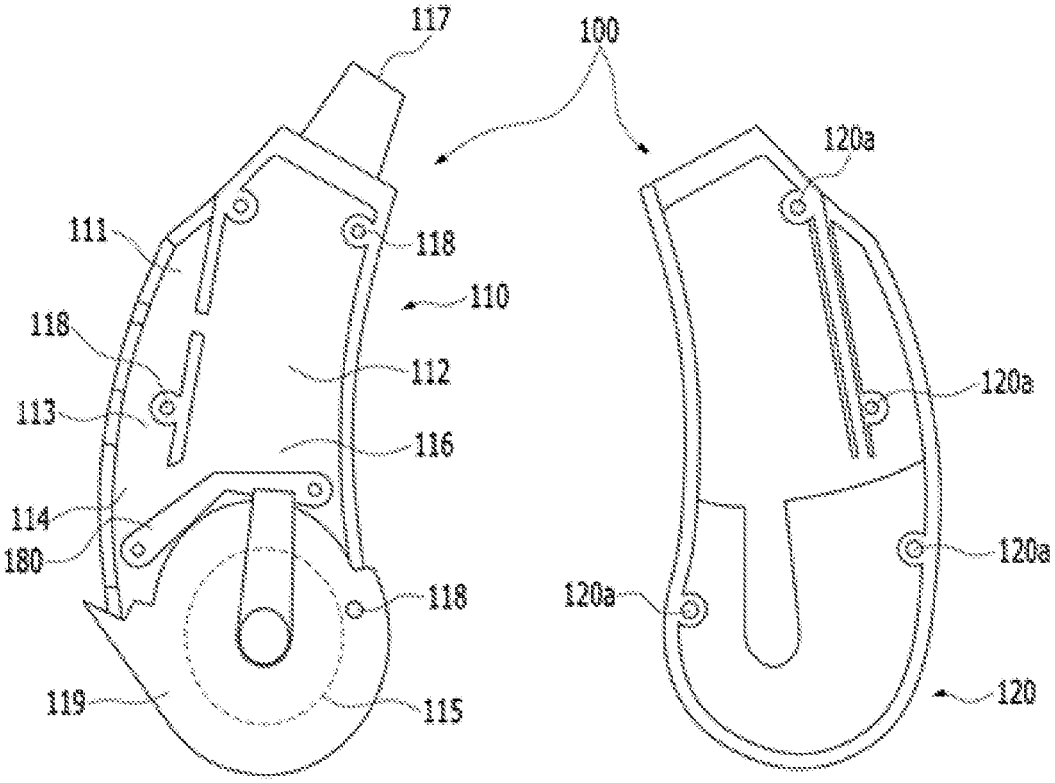
FIG. 6 is an exploded diagram of a case body and a cover of an earring hearing aid using RIT according to the present disclosure.

Hereinafter, the preferred embodiments of an earring hearing aid using RIT according to the present disclosure will be described in detail with reference to the accompanying drawings. For reference, the terms and words used in the specification and the appended claims should not be construed as limited to general or dictionary meanings, but interpreted based on the meanings and concepts corresponding to the technical spirit of the present disclosure on the basis of the principle that the inventor is allowed to define terms appropriately for the best explanation. Additionally, the embodiments described herein and illustrations shown in the drawings are just a most preferred embodiment of the present disclosure, but not intended to fully describe the technical spirit of the present disclosure, so it should be understood that other equivalents and modifications could be made thereto at the time the application was filed.

Figure 7:
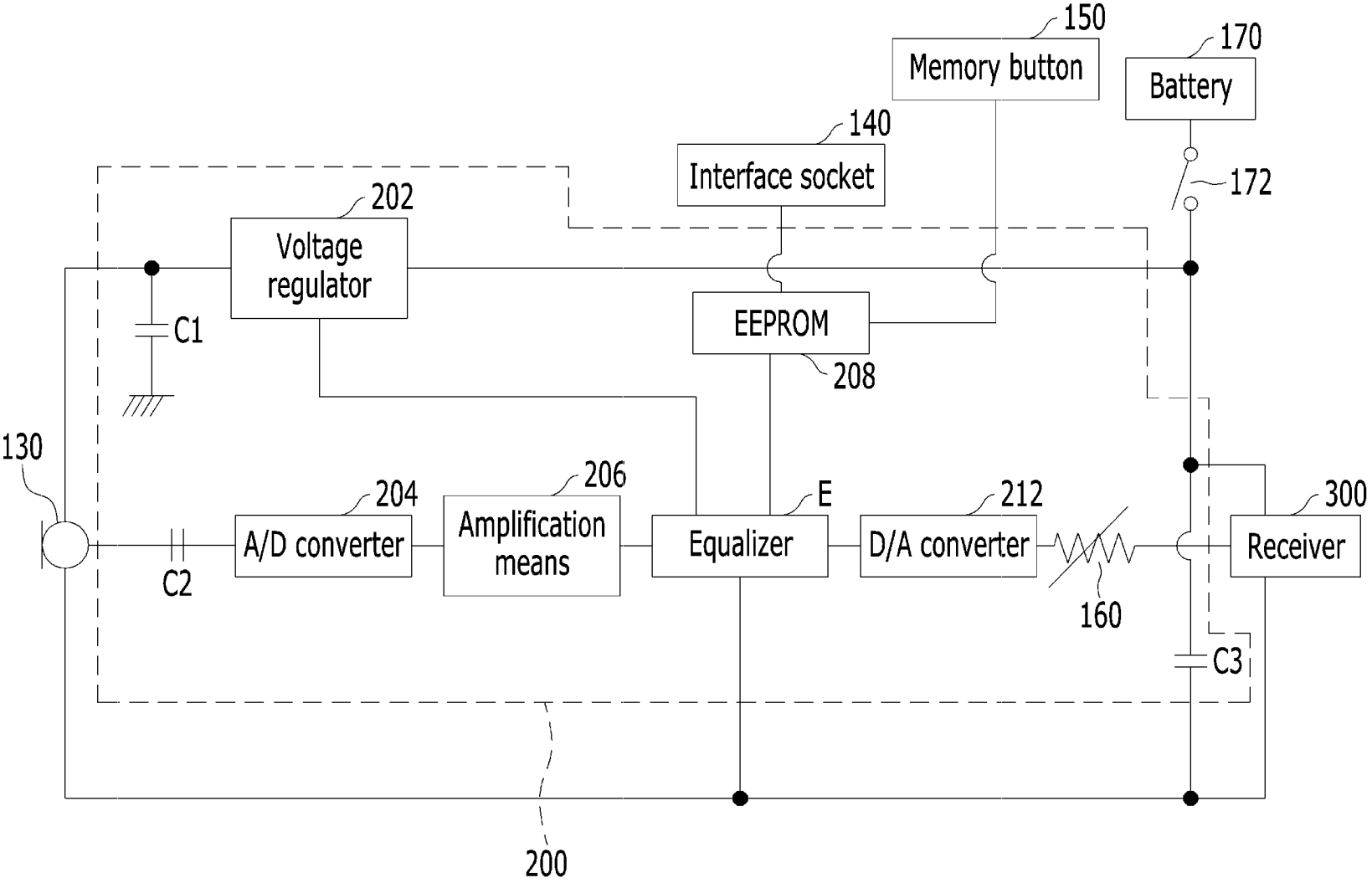
FIG. 7 is a circuit block diagram of an acoustic processing means connected to a microphone, a battery and a receiver employed in an earring hearing aid using RIT according to the present disclosure.

FIGS. 3 to 6 are diagrams showing an earring hearing aid using RIT according to the present disclosure, and FIG. 7 is a circuit block diagram of an acoustic processing means connected to a microphone, a battery and a receiver employed in the earring hearing aid using RIT according to the present disclosure.

The earring hearing aid using RIT according to the present disclosure includes a case 100, a receiver 300, a third capacitor C3, a hearing aid shell 400, a face plate 500 and a hook 600.

The case 100 is formed such that a microphone 130, an interface socket 140, an acoustic processing means 200, a memory button 150, a volume controller 160, a battery 170 and a battery electrode 180 are received therein.

The receiver 300 outputs an acoustic signal through a lead wire 210 having one end connected to the acoustic processing means 200, and is connected to the other end of the lead wire 210 and inserted into a receiver tube 302 having a predetermined length.

The third capacitor C3 filters out high-level noise included in direct voltage supplied from the battery 170 to the receiver 300 to prevent the high-level noise from being applied to the receiver 300.

The hearing aid shell 400 receives therein the end of the receiver tube 302 disposed at the opposite side to the side into which the receiver 300 is inserted in the receiver tube 302 along the lengthwise direction, and is inserted into the ear to allow the hearing of sound outputted from the receiver 300.

That is, dissimilar to a receiver in the canal (RIC) type in which a receiver inserted into a receiver tube is received in a hearing aid shell as conventionally, the present disclosure relates to a RIT type earring hearing aid in which only the end of the receiver tube disposed at the opposite side to the insertion side of the receiver is received.

The face plate 500 is formed to cover an inlet of the hearing aid shell 400.

The hook 600 has one side that is inserted into the outer peripheral surface of an exit hole 117 of the case 100 to cover the outer peripheral surface of the lead wire 210 exiting through the exit hole 117, and the other side that is rounded to be held and fixed to the ear.

In this instance, a plurality of markers T1,T2,T3 is formed at a predetermined interval along the lengthwise direction on the outer periphery of the receiver tube 302 adjacent to the case 100, and when the receiver 300 connected to the other end of the lead wire 210 is inserted into the receiver tube 302 and fixed at a predetermined location, the receiver tube 302 may be cut along two or more of the plurality of markers T1,T2,T3 formed in the receiver tube 302, and the receiver tube 302 into which the receiver 300 is inserted may be connected to the receiver tube 302 connected to the hearing aid shell 400, so that the length from the case 100 to the hearing aid shell 400 inserted into the ear fits for the user's ear size.

In this case, the end of the receiver tube 302 into which the receiver 300 is inserted and the end of the receiver tube 302 connected to the hearing aid shell 400 correspond to each other, and when an adhesive is applied to at least one of the two ends and they are connected to each other, they may be firmly fixed.

That is, the receiver tube 302 is manufactured in a predetermined length in the manufacturing process, and the receiver tube 302 is marked with T1, T2, T3, dividing into three parts along the lengthwise direction, on the outer periphery.

This is to adjust the length of the receiver tube 302 by cutting the receiver tube 302 along two or more markers after forming the markers T1, T2, T3 standardized in three lengths on the outer surface of the receiver tube 302 in the manufacture, because the length between the case 100 disposed behind the ear and the hearing aid shell 400 inserted into the external auditory meatus is different for each person.

As described above, the present disclosure fits each user.

In another configuration, the receiver 300 is inserted into the receiver tube 302 adjacent to the case 100, and the receiver 300 may be fixed to a location where one of the plurality of markers T1,T2,T3 is formed in the receiver tube 302 so that the length from the case 100 to the hearing aid shell 400 inserted into the ear fits for the user's ear size.

That is, the receiver tube 302 is manufactured in a predetermined length in the manufacturing process, and the receiver tube 302 is marked with T1, T2, T3, dividing into three parts along the lengthwise direction, on the outer periphery.

In this instance, the receiver 300 is inserted into the receiver tube 302 together with the lead wire 210, and the receiver 300 is fixed to a location marked with T1, T2 or T3.

When an adhesive is applied to the end of the receiver 300 and the receiver 300 is slowly inserted into the receiver tube 302 together with the lead wire, the receiver 300 is completely fixed in a few minutes.

As described above, after the receiver tube 302 is made in a predetermined length, with a change in the location of the receiver 300 within the receiver tube 302, the distance from the sound outlet of the receiver 300 to the eardrum changes, and in this instance, the intensity of low frequency sound of 400 Hz or less changes for each frequency range by the resonance effect.

As the receiver 300 is closer to the external auditory meatus within the receiver tube 302, the resonance frequency range increases to 200 to 400 Hz high frequencies, and on the contrary, as the receiver 300 is closer to the case 100, the resonance frequency range reduces to 50 to 200 Hz frequencies.

Most of people with age-related hearing loss hear high frequency range sounds worse than low frequency range sounds, and amplification in the case 100 primarily adjusts the high frequency range, and the amplification effect in the low frequency range may be adjusted by changing the location of the receiver 300 within the receiver tube 302 according to each user.

Meanwhile, the case 100 includes a case body 110, and a cover 120 having a screw hole 120*a* to cover an opening of the case body 110 by fastening with a fastening bolt 90, and the case body 110 includes a first receiving space 111 that receives the microphone 130, a second receiving space 112 that receives the acoustic processing means 200, a third receiving space 113 that receives the memory button 150, a fourth receiving space 114 that receives the volume controller 160, a fifth receiving space 115 that receives the battery 170, a sixth receiving space 116 that receives the battery electrode 180 in contact with each of the positive electrode and the negative electrode of the battery 170, an exit hole 117 through which the lead wire 210 exits, the lead wire 210 for outputting an acoustic signal from the acoustic processing means 200 to the receiver 300, and a screw hole 118 for the fastening bolt 90 to couple the case body 110 and the cover 120.

Further, as shown in FIG. 7, the acoustic processing means 200 includes a voltage regulator 202 that when a switch 172 is operated to switch on, receives the direct voltage supplied from the battery 170, regulates to a predetermined direct voltage and outputs it, a first capacitor C1 that filters out high-level noise included in the direct voltage regulated to the predetermined direct voltage by the voltage regulator 202 and supplies to the microphone 130, a second capacitor C2 that receives the acoustic signal received by the microphone 130 and filters out high-level noise included in the acoustic signal, an A/D converter 204 that receives the analog acoustic signal from which high-level noise was filtered out by the second capacitor C2 and converts into a digital acoustic signal, an amplification means 206 that receives the digital acoustic signal outputted from the A/D converter 204 and amplifies to a predetermined level, an EEPROM 208 that receives a news hearing parameter M1, a music hearing parameter M2, a conversation hearing parameter M3 and a conversation hearing in noise parameter M4 from a personal computer through the interface socket 140 and stores an interfaced mode signal, an equalizer E that receives a corresponding parameter among the news hearing parameter M1, the music hearing parameter M2, the conversation hearing parameter M3 and the conversation hearing in noise parameter M4 when the memory button 150 is pressed once to four times, receives the digital acoustic signal amplified to the predetermined level from the amplification means 206, and amplifies and mixes them, a D/A converter 212 that converts the digital acoustic signal amplified and mixed by the equalizer E into an analog acoustic signal, a volume controller 160 that receives the analog acoustic signal outputted from the D/A converter 212, controls the volume and outputs it, and a third capacitor C3 that filters out high-level noise included in the direct voltage supplied from the battery 170 to the receiver 300 to prevent the high-level noise from being applied to the receiver 300.

Here, the reference number 304 not described herein is an earwax entry prevention element inserted into the front end of the receiver tube 302 to prevent earwax from entering the receiver tube 302, the reference number 504 is a string connected to the outer side of the face plate 500 and used to pull when drawing out the hearing aid shell 400 inserted into the ear canal, and the string 504 has a round knot 504*a* at the outer end to easily pull.

Additionally, the reference number 119 not described herein is a cover that covers the battery.

Hereinafter, the operation and effect of the earring hearing aid using RIT according to the present disclosure configured as described above will be described.

First, the microphone 130 is installed in the first receiving space 111 formed in the case body 110 of the case 100, the acoustic processing means 200 is installed in the second receiving space 112, the memory button 150 is installed in the third receiving space 113, the volume controller 160 is installed in the fourth receiving space 114, the battery 170 is installed in the fifth receiving space 115, the battery electrode 180 in contact with each of the positive electrode and the negative electrode of the battery 170 is installed in the sixth receiving space 116, the interface socket 140 is installed in the cover 120 to access the personal computer not shown, receive a news hearing parameter M1, a music hearing parameter M2, a conversation hearing parameter M3 and a conversation hearing in noise parameter M4, and store an interfaced mode signal in the EEPROM 208, the opening of the case body 110 is covered with the cover 120, and the screw hole 118 formed in the case body 110 and the screw hole 120*a* formed in the cover 120 correspond to each other and they are fastened by the fastening bolt 90.

The outer peripheral surface of the lead wire 210 exiting through the exit hole 117 formed by the case body 110 and the cover 120 and the exit hole 117 are covered with the earring hook 600, the other side of the lead wire 210 is inserted into a through-hole 502 formed in the face plate 500, and the receiver 300 is connected.

Additionally, the receiver 300 is inserted into the receiver tube 302, the end of the receiver tube 302 disposed at the opposite side to the installation side of the receiver 300 is inserted into the hearing aid shell 400, and the face plate 500 is installed in an opening (not shown) of the hearing aid shell 400 using an adhesive or a bolt.

After the earring hearing aid of the present disclosure is assembled as described above, when the earring hook 600 is held on the ear, the case 100 sits behind the ear, and in this instance, the hearing aid shell 400 is inserted into the ear canal, and the switch 172 is operated to switch on.

Accordingly, when the third capacitor C3 filters out high-level noise included in direct voltage supplied from the battery 170 and supplies to the receiver 300, the voltage regulator 202 receives the direct voltage supplied from the battery 170, regulates to a predetermined direct voltage and supplies operating voltage to the equalizer 210, and the first capacitor C1 filters out high-level noise included in the direct voltage regulated to the predetermined direct voltage by the voltage regulator 202 and supplies operating power to the microphone 130.

In this instance, when the second capacitor C2 receives an acoustic signal received by the microphone 130, filters out high-level noise included in the acoustic signal and outputs to the A/D converter 204, the A/D converter 204 receives the high-level noise filtered analog acoustic signal and converts into a digital acoustic signal, and the amplification means 206 receives the digital acoustic signal outputted from the A/D converter 204 and amplifies to a predetermined level.

Additionally, as the news hearing parameter M1 for hearing news, the music hearing parameter M2 for hearing music, the conversation hearing parameter M3 for hearing conversation and the conversation hearing in noise parameter M4 for hearing conversation in noise are received from the personal computer not shown through the interface socket 140 and the interfaced mode signal is stored in the EEPROM 208, when a suitable parameter for an environment at a location of a wearer wearing the earring hearing aid of the present disclosure is selected by pressing the memory button 150 any one of once to four times according to the surrounding environment, the EEPROM 208 outputs the parameter selected by the memory button 150 among the M1 to M4 parameters to the equalizer E.

Accordingly, the equalizer E receives the digital acoustic signal amplified to the predetermined level by the amplification means 206, receives one mode of the news hearing parameter M1, the music hearing parameter M2, the conversation hearing parameter M3 and the conversation hearing in noise parameter M4 set by the memory button 150 from the EEPROM 208, and amplifies and mixes them.

Additionally, the D/A converter 212 receives the digital acoustic signal amplified and mixed by the equalizer E and converts into an analog acoustic signal, and the volume controller 160 controls the volume of the analog acoustic signal outputted from the D/A converter 212 and outputs to the receiver 300.

Accordingly, the present disclosure installs the receiver 300 connected to the other end of the lead wire 210 within the receiver tube 302 and allows only the end of the receiver tube 302 disposed at the opposite side to the installation side of the receiver 300 to be inserted into the hearing aid shell 400, thereby cancelling an acoustic feedback phenomenon, and preventing the conventional problem with frequent failures due to corrosion caused by earwax and sweat because of the receiver 300 configured to be inserted into the external auditory meatus.

Additionally, the plurality of markers T1, T2, T3 is formed at a predetermined interval along the lengthwise direction on the outer periphery of the receiver tube 302 to adjust the length of the lead wire 210 or the receiver tube 302 as needed, and thus the present disclosure fits each user.

The present disclosure as described hereinabove is not limited by the above-described embodiments and the accompanying drawings, and it will be obvious to those having ordinary skill in the technical field pertaining to the present disclosure that many substitution, modification and changes may be made thereto without departing from the technical spirit of the present disclosure.

The invention claimed is:

1. An earring hearing aid using a receiver in the tube (RIT), comprising:

a case which receives therein a microphone, an interface socket, an acoustic processing means, a memory button, a volume controller, a battery and a battery electrode;

a receiver which outputs an acoustic signal through a lead wire having one end connected to the acoustic processing means, and is connected to an other end of the lead wire and inserted into a receiver tube having a predetermined length;

a third capacitor which filters out high-level noise included in direct voltage supplied from the battery to the receiver to prevent the high-level noise from being applied to the receiver;

a hearing aid shell which receives an end of the receiver tube disposed at an opposite side to a side where the receiver is inserted in the receiver tube along a lengthwise direction, and is inserted into an ear to allow the hearing of sound outputted from the receiver;

a face plate covering an inlet of the hearing aid shell; and an earring hook having one side inserted into an outer peripheral surface of an exit hole of the case to cover an outer peripheral surface of the lead wire exiting through the exit hole, and an other side rounded to be held and fixed to the ear, wherein a plurality of markers is formed at a predetermined interval along the lengthwise direction on an outer periphery of the receiver tube adjacent to the case, and wherein the receiver is inserted into the receiver tube, and the receiver is fixed to a location where one of the plurality of markers is formed in the receiver tube such that a length from the case to the hearing aid shell inserted into the ear fits for a user's ear size.

2. The earring hearing aid using RIT of claim 1, wherein when the receiver connected to the other end of the lead wire is inserted into the receiver tube and fixed at a predetermined location, the receiver tube is cut along two or more of the plurality of markers formed in the receiver tube such that a length from the case to the hearing aid shell inserted into the ear fits for a user's ear size, and the receiver tube having the inserted receiver is connected to the receiver tube connected to the hearing aid shell.

3. The earring hearing aid using RIT of claim 1, wherein the case includes a case body, and a cover having a screw hole to cover an opening of the case body by fastening with a fastening bolt, wherein the case body comprising:

a first receiving space which receives the microphone;

a second receiving space which receives the acoustic processing means;

a third receiving space which receives the memory button;

a fourth receiving space which receives the volume controller;

a fifth receiving space which receives the battery;

a sixth receiving space which receives the battery electrode in contact with each of a positive electrode and a negative electrode of the battery;

the exit hole through which the lead wire exits, the lead wire for outputting the acoustic signal from the acoustic processing means to the receiver; and the screw hole for the fastening bolt to couple the case body and the cover.

4. The earring hearing aid using RIT of claim 1, wherein the acoustic processing means comprising:

a voltage regulator to receive the direct voltage supplied from the battery and regulate to a predetermined direct voltage and output it, when a switch is operated to switch on;

a first capacitor filtering out high-level noise included in the direct voltage regulated to the predetermined direct voltage by the voltage regulator and supplying to the microphone;

a second capacitor receiving an acoustic signal received by the microphone and filtering out high-level noise included in the acoustic signal;

an Analog to Digital converter (A/D converter) receiving an analog acoustic signal having undergone high-level noise filtering by the second capacitor and converting into a digital acoustic signal;

an amplification means receiving the digital acoustic signal outputted from the A/D converter and amplifying to a predetermined level;

an Electrically Erasable Programmable Only Memory (EEPROM) receiving a news hearing parameter, a music hearing parameter, a conversation hearing parameter and a conversation hearing in noise parameter from a personal computer through the interface socket and storing an interfaced mode signal;

an equalizer receiving a corresponding parameter among the news hearing parameter, the music hearing parameter, the conversation hearing parameter and the conversation hearing in noise parameter when the memory button is pressed once to four times, receiving the digital acoustic signal amplified to the predetermined level by the amplification means and amplifying and mixing them;

a Digital to Analog converter (D/A converter) converting the digital acoustic signal amplified and mixed by the equalizer into an analog acoustic signal;

the volume controller receiving the analog acoustic signal outputted from the D/A converter, controlling volume and outputting it; and the third capacitor filtering out high-level noise included in the direct voltage supplied from the battery to the receiver to prevent the high-level noise from being applied to the receiver.

5. An earring hearing aid using a receiver in the tube (RIT), comprising:

a case which receives therein a microphone, an interface socket, an acoustic processing means, a memory button, a volume controller, a battery and a battery electrode;

a receiver which outputs an acoustic signal through a lead wire having one end connected to the acoustic processing means, and is connected to an other end of the lead wire and inserted into a receiver tube having a predetermined length;

a hearing aid shell which receives an end of the receiver tube disposed at an opposite side to a side;

a face plate covering an inlet of the hearing aid shell; and an earring hook having one side inserted into an outer peripheral surface of an exit hole of the case to cover an outer peripheral surface of the lead wire exiting through the exit hole, wherein a plurality of markers is formed at a predetermined interval along the lengthwise direction on an outer periphery of the receiver tube, and wherein the receiver is inserted into the receiver tube, and the receiver is fixed to a location where one of the plurality of markers is formed in the receiver tube such that a length from the case to the hearing aid shell inserted into the ear fits for a user's ear size.

6. The earring hearing aid using RIT of claim 5, wherein when the receiver connected to the other end of the lead wire is inserted into the receiver tube and fixed at a predetermined location, the receiver tube is cut along two or more of the plurality of markers formed in the receiver tube such that a length from the case to the hearing aid shell inserted into the ear fits for a user's ear size, and the receiver tube having the inserted receiver is connected to the receiver tube connected to the hearing aid shell.

7. The earring hearing aid using RIT of claim 5, wherein the case includes a case body, and a cover having a screw hole to cover an opening of the case body by fastening with a fastening bolt, wherein the case body comprising:

a first receiving space which receives the microphone;

a second receiving space which receives the acoustic processing means;

a third receiving space which receives the memory button;

a fourth receiving space which receives the volume controller;

a fifth receiving space which receives the battery;

a sixth receiving space which receives the battery electrode in contact with each of a positive electrode and a negative electrode of the battery;

the exit hole through which the lead wire exits, the lead wire for outputting the acoustic signal from the acoustic processing means to the receiver; and the screw hole for the fastening bolt to couple the case body and the cover.

8. The earring hearing aid using RIT of claim 5, wherein the acoustic processing means comprising:

a voltage regulator to receive the direct voltage supplied from the battery and regulate to a predetermined direct voltage and output it, when a switch is operated to switch on;

a first capacitor filtering out high-level noise included in the direct voltage regulated to the predetermined direct voltage by the voltage regulator and supplying to the microphone;

a second capacitor receiving an acoustic signal received by the microphone and filtering out high-level noise included in the acoustic signal;

an Analog to Digital converter (A/D converter) receiving an analog acoustic signal having undergone high-level noise filtering by the second capacitor and converting into a digital acoustic signal;

an amplification means receiving the digital acoustic signal outputted from the A/D converter and amplifying to a predetermined level;

an Electrically Erasable Programmable Only Memory (EEPROM) receiving a news hearing parameter, a music hearing parameter, a conversation hearing parameter and a conversation hearing in noise parameter from a personal computer through the interface socket and storing an interfaced mode signal;

an equalizer receiving a corresponding parameter among the news hearing parameter, the music hearing parameter, the conversation hearing parameter and the conversation hearing in noise parameter when the memory button is pressed once to four times, receiving the digital acoustic signal amplified to the predetermined level by the amplification means and amplifying and mixing them;

a Digital to Analog converter (D/A converter) converting the digital acoustic signal amplified and mixed by the equalizer into an analog acoustic signal;

the volume controller receiving the analog acoustic signal outputted from the D/A converter, controlling volume and outputting it; and the third capacitor filtering out high-level noise included in the direct voltage supplied from the battery to the receiver to prevent the high-level noise from being applied to the receiver.

* * * * *